US008904985B2

(12) United States Patent
Weiss et al.

(10) Patent No.: US 8,904,985 B2
(45) Date of Patent: Dec. 9, 2014

(54) METHOD FOR STARTING AN INTERNAL COMBUSTION ENGINE WITH START-STOP FUNCTION

(75) Inventors: Ruediger Weiss, Moetzingen (DE); Jean-Marc Tonye Djon, Stuttgart (DE); Jochen Laubender, Markgroeningen (DE); Manfred Dietrich, Markgroeningen (DE); Elias Calva, Stuttgart (DE); Karsten Kroepke, Pudong New Area (CN)

(73) Assignee: Robert Bosch GmbH, Stuttgart (DE)

( * ) Notice: Subject to any disclaimer, the term of this patent is extended or adjusted under 35 U.S.C. 154(b) by 1175 days.

(21) Appl. No.: 12/864,148

(22) PCT Filed: Nov. 11, 2008

(86) PCT No.: PCT/EP2008/065274

§ 371 (c)(1),
(2), (4) Date: Dec. 9, 2010

(87) PCT Pub. No.: WO2009/092466

PCT Pub. Date: Jul. 30, 2009

(65) Prior Publication Data

US 2011/0088647 A1 Apr. 21, 2011

(30) Foreign Application Priority Data

Jan. 22, 2008 (DE) ..... 10 2008 005 525

(51) Int. Cl.

| | |
|---|---|
| ***F02N 11/08*** | (2006.01) |
| *F02P 5/15* | (2006.01) |
| *F02D 41/00* | (2006.01) |
| *F02D 41/06* | (2006.01) |

(52) U.S. Cl.

CPC ..... *F02N 11/0848* (2013.01); *F02P 5/1506* (2013.01); *F02D 2041/0095* (2013.01); *F02D 2200/1012* (2013.01); *F02N 11/0814* (2013.01); *F02D 2250/14* (2013.01); *F02D 41/065* (2013.01)

USPC ..... 123/179.4

(58) Field of Classification Search

CPC ..... F02D 2200/1012; F02D 41/065; F02D 2400/06; F02D 41/062; F02D 41/064; F02N 2200/022; Y02T 10/48

USPC ..... 123/179.1, 179.16, 179.17, 179.4, 123/179.5, 406.11, 406.12, 406.53, 491

See application file for complete search history.

(56) References Cited

U.S. PATENT DOCUMENTS

| | | | | |
|---|---|---|---|---|
| 4,402,286 | A * | 9/1983 | Pagel et al. | 123/179.3 |
| 6,772,723 | B2 * | 8/2004 | Aoki et al. | 123/179.4 |
| 7,134,412 | B2 * | 11/2006 | Beer et al. | 123/179.16 |

FOREIGN PATENT DOCUMENTS

| | | |
|---|---|---|
| EP | 1 288 491 | 3/2003 |
| EP | 1 422 421 | 5/2004 |

(Continued)

*Primary Examiner* — Mahmoud Gimie
*Assistant Examiner* — Sizo Vilakazi
(74) *Attorney, Agent, or Firm* — Kenyon & Kenyon LLP

(57) ABSTRACT

In a method for starting an internal combustion engine (60) having multiple combustion chambers (62, 64, 66, 68), wherein said internal combustion engine (60) has a starting system (50) and is operated using a start-stop function, and wherein said starting system (50) is actuated after a stop phase in operation of said internal combustion engine (60) to restart said internal combustion engine (60), a combustion chamber (62, 64, 66, 68) to be ignited first of the multiple combustion chambers (62, 64, 66, 68) is determined upon a restart of the internal combustion engine (60), and after a first ignition of the combustion chamber (62, 64, 66, 68) to be ignited first, speed data for the internal combustion engine (60) are detected, and a starter release of the starting system (50) is caused if the detected speed data meet a predetermined starter release criterion.

12 Claims, 2 Drawing Sheets

(56) References Cited

FOREIGN PATENT DOCUMENTS

| | | |
|---|---|---|
| EP | 1 712 765 | 10/2006 |
| JP | 2005-69237 | 3/2005 |
| JP | 2006-13166 | 1/2006 |
| JP | 2006-13168 | 1/2006 |
| JP | 2007-32358 | 2/2007 |
| JP | 2007-51599 | 3/2007 |

* cited by examiner

METHOD FOR STARTING AN INTERNAL COMBUSTION ENGINE WITH START-STOP FUNCTION

This application is a National Stage Application of PCT/EP2008/065274, filed 11 Nov. 2008, which claims benefit of Serial No. 10 2008 005 525.5, filed 22 Jan. 2008 in Germany and which applications are incorporated herein by reference. To the extent appropriate, a claim of priority is made to each of the above disclosed applications.

BACKGROUND

The present invention relates to a method for starting an internal combustion engine having multiple combustion chambers, wherein said internal combustion engine has a starting system and is operated using a start-stop function and wherein said starting system is actuated after a stop phase in operation of said internal combustion engine to restart said internal combustion engine.

Internal combustion engines using so-called start-stop functions are already known from the technical field. Such internal combustion engines are as a rule automatically switched off during shutdown by a fuel injection cutout for reasons of consumption reduction, respectively fuel savings. In order to switch the internal combustion engine on again, a new start command is generated, for example by an operator of the internal combustion engine, so that a starting system associated with said internal combustion engine, for example a starter motor, is actuated for carrying out a restarting of said engine, respectively a renewed starting process by means of rotating the starter motor.

The disadvantage of the technical field is that in the case of such internal combustion engines, switching said engine on again after a stop phase represents a load on the onboard power supply system. This load can lead to undesirable noises, which are perceived to be unpleasant. Said noises can particularly occur during an actuation of the prefeed pump and/or of the starter motor of the internal combustion engine, said actuation being required for restarting said engine.

SUMMARY

It is therefore an aim of the invention to state a method and a device, which after a stop phase allow for a restart of an internal combustion engine having a start-stop function with a reduced run-time of the starting system.

This aim is met by means of a method for starting an internal combustion engine having multiple combustion chambers. Said internal combustion engine has a starting system and is operated using a start-stop function. The starting system is actuated after a stop phase in operation of said internal combustion engine to restart said internal combustion engine. A combustion chamber to be ignited first of the multiple combustion chambers is determined upon a restart of the internal combustion engine; and after a first ignition of the combustion chamber to be ignited first, speed data for the internal combustion engine are detected. The time frame, in which the data are detected, can be finely adjusted in position as well as width per data input. A starter release of the starting system is caused if the detected speed data meet a predetermined starter release criterion.

The invention consequently allows for the load on the onboard power supply system to be reduced by the starting system when restarting an internal combustion engine having a start-stop function.

Provision is preferably made for the predetermined starter release criterion to be met if the detected speed data represent an increase in rotational speed with a gradient, which exceeds a predetermined threshold value, and/or if a regional maximum speed is detected. The regional maximum rotational speed is ascertained by determining a regional maximum compression in a second compression chamber. In so doing, the second combustion chamber is next to be ignited after the combustion chamber to be ignited first.

This makes it possible to assuredly assess whether the restart of the internal combustion engine will be successful, and the starter release is thus practical.

The combustion chamber to be ignited first is preferably determined in the stop phase of the internal combustion engine. Furthermore, ignition angle, charge and injection timing of the combustion chamber to be ignited first are determined such that the absolute angle and the cylinder-specific ignition angle are known before carrying out the restart of the internal combustion engine.

A suitable point in time can thus be determined, whereat upon restart of the internal combustion engine the detection of the speed data is begun.

According to one embodiment, the speed data are detected in a predetermined time interval after the first ignition of the combustion chamber to be ignited first. In so doing, the speed data are preferably detected at predetermined intervals during the predetermined time interval. The predetermined time interval has a length, which is determined on the basis of a predetermined width in degrees of crankshaft rotation, a predetermined number of detected speed data or a detection of a regional maximum rotational speed after the ignition of the combustion chamber to be ignited first. The starter release of the starting system is preferably only then caused if the predetermined time interval has elapsed.

A determination can thus be assuredly and reliably made whether the detected speed data meet the predetermined starter release criterion.

The problem mentioned at the beginning of the application is also solved by a computer program for carrying out a method for starting an internal combustion engine having multiple combustion chambers. Said internal combustion engine has a starting system and is operated using a start-stop function. The starting system is actuated after a stop phase in operation of said internal combustion engine to restart said internal combustion engine. Upon a restart of the internal combustion engine, the computer program determines a combustion chamber to be ignited first of the multiple combustion chambers and detects speed data for the internal combustion engine after a first ignition of the combustion chamber to be ignited first. The computer program causes a starter release of the starting system if the detected speed data meet a predetermined starter release criterion.

The problem mentioned at the beginning of the application is also solved by an internal combustion engine having multiple combustion chambers. The internal combustion engine has a starting system and is operated using a start-stop function. Said starting system is actuated after a stop phase in operation of said internal combustion engine to restart said internal combustion engine. A combustion chamber to be ignited first of the multiple combustion chambers can be determined upon a restart of the internal combustion engine; and after a first ignition of the combustion chamber to be ignited first, speed data for the internal combustion engine are detected; and a starter release of the starting system is caused if the detected speed data meet a predetermined starter release criterion.

BRIEF DESCRIPTION OF THE DRAWINGS

An example of embodiment of the present invention is explained below in detail with the aid of the accompanying drawings.

DETAILED DESCRIPTION

Figure 1:
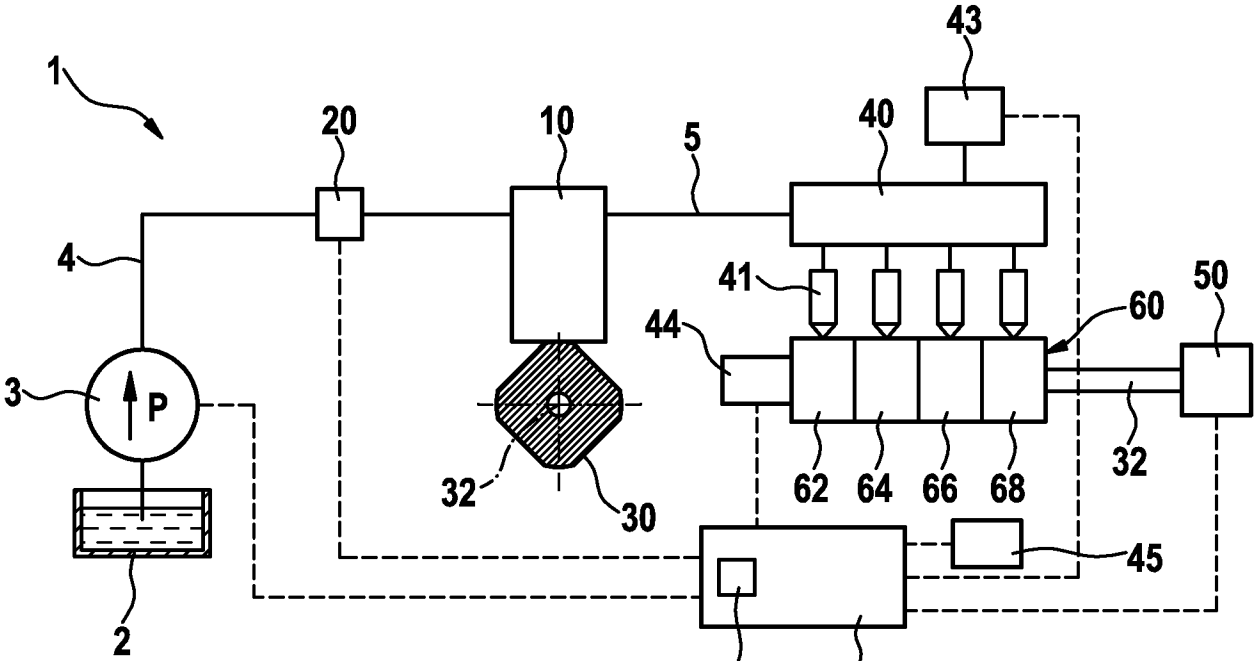
FIG. 1 a schematic depiction of a fuel injection system of an internal combustion engine having a high pressure pump.

FIG. 1 shows a schematic depiction of a fuel injection system 1 of an internal combustion engine 60 having a start-stop function. This comprises a fuel tank 2, from which a prefeed pump 3 pumps fuel via a connection line 4 to a fuel high pressure pump 10, which is driven by a cam 30. A quantity control valve 20 is provided on the low pressure side of the high pressure pump 10. The feed quantity of the high pressure pump 10 is adjusted by means of said quantity control valve 20. The cam 30 is driven by the internal combustion engine 60, for example by an associated cam- or crankshaft 32. Said cam 30 can also be a component part of this cam- or crankshaft 32.

Said cam- or crankshaft 32 is for its part connected to a starting system 50. In this case, it preferably relates to an integrated starter generator on said cam- or crankshaft 32 or a belt driven starter generator. It is however also conceivable to use conventional starters, respectively starter motors.

The high pressure pump 10 preferably has a delivery chamber with a check valve disposed on the inlet side. Said pump 10 compresses the fuel to a very high pressure and feeds it via a connection line 5 into a high pressure accumulator 40, in which the fuel is stored under very high pressure and which also is denoted as a distributor tube, respectively rail. A plurality of injection valves, respectively injectors 41, is connected to said rail. Said injectors 41 inject the fuel directly into combustion chambers associated with them of the internal combustion engine 60, which is not depicted in detail. The internal combustion engine 60 has, for example, four combustion chambers 62, 64, 66, 68 and serves, for example, to drive a motor vehicle.

The actual fuel pressure in the high pressure accumulator 40 is detected by a pressure sensor 43. Said pressure sensor 43 transmits its signals to a control and regulation device 46, which is also connected to a temperature sensor 45 and to a rotational speed sensor 44 attached to the internal combustion engine 60. For this purpose, the rotational speed sensor 44 can alternatively be disposed on the cam- or crankshaft 32. The control and regulation device 46 is connected to the prefeed pump 3 and the quantity control valve 20 on the outlet side.

The control and regulation device 46 implements the start-stop function of the internal combustion engine 60 and causes a fuel injection cutout to automatically switch off the internal combustion engine 60 when a so-called "engine stop" occurs, i.e. during shutdown of the internal combustion engine 60, in particular for reasons of consumption reduction, respectively fuel savings. During a stop phase of the internal combustion engine 60 subsequent to the engine shutdown, a combustion chamber n to be ignited first of the multiple combustion chambers 62, 64, 66, 68 is determined upon a restart of the internal combustion engine 60 according to one embodiment of the invention. In so doing, ignition angle, charge and injection timing of the combustion chamber n are preferably determined so that before carrying out the restart of the internal combustion engine 60, the absolute angle ZOTn[EKW] (Ignition TDCn [Ecrankshaft rotation]) and the cylinder-specific ignition angle are known. When restarting the internal combustion engine 60, speed data for the internal combustion engine 60 are then detected after a first ignition of the combustion chamber n and are stored by the control and regulation device 46 on a storage medium 47, which can be used with the control and regulation device 46. On the basis of the stored speed data, the control and regulation device 46 determines whether these meet a predetermined starter release criterion as described below in detail with reference to FIG. 2. If the predetermined starter release criterion is met, the control and regulation device 46 causes a starter release of the starting system 50.

According to a preferred embodiment of the invention, a corresponding method for controlling the internal combustion engine 60 is implemented as a computer program, which can be carried out by the control and regulation device 46. This computer program is, for example, stored on an electronic storage medium 47. The invention can therefore be simply and cost effectively implemented with components of the internal combustion engine 60, which are already present.

Figure 2:
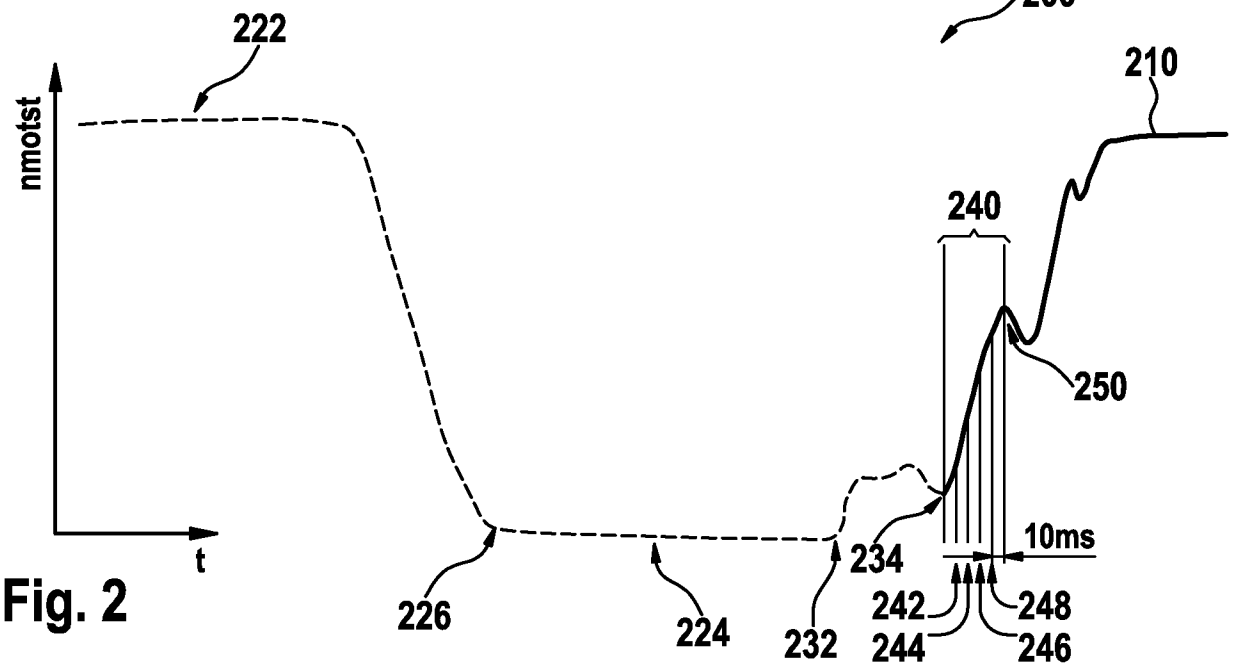
FIG. 2 a schematic depiction of the temporal course of a method for controlling the fuel injection system of FIG. 1 upon a restart of the internal combustion engine.

FIG. 2 shows a diagram 200, which with the aid of an example depicts a temporal course of an engine rotational speed nmotst of the internal combustion engine 60 of FIG. 1, which is operated using the start-stop function, from the beginning of a stop phase up until carrying out a restart of said internal combustion engine 60. According to one embodiment of the invention, the diagram 200 clarifies a method for determining a suitable point in time for a starter release upon restart of the internal combustion engine 60 of FIG. 1.

As can be seen from the temporal course 210, the internal combustion engine is initially operated with a rotational speed 222 before a transition to a stop phase 224, wherein the rotational speed of the internal combustion engine is 0 rpm, occurs at a point in time 226. During the stop phase, a combustion chamber of the internal combustion engine to be ignited first is preferably determined, i.e. one of the multiple combustion chambers 62, 64, 66, 68. Furthermore, ignition angle, charge and injection timing of said combustion chamber are preferably determined such that the absolute angle ZOTn[EKW] (Ignition TDCn[E of crankshaft rotation]) and the cylinder-specific ignition angle are known before carrying out the restart of the internal combustion engine 60. An ignition point for the combustion chamber to be ignited first is determined on the basis of the absolute angle ZOTn[EKW] (Ignition TDCn[E of crankshaft rotation]) and the cylinder-specific ignition angle, i.e. a point in time, whereat a first ignition of said combustion chamber occurs after the stop phase. The detection of the rotational speed data is started at this ignition point.

It is assumed for the additional detailed information that the combustion chamber to be ignited first upon a restart of the internal combustion engine is the combustion chamber 66 and that the combustion chamber 68 is ignited as the second combustion chamber in the further firing order. It is furthermore assumed that a first ignition of the combustion chamber 66 occurs after the stop phase 224 at the point in time 234.

A restart of the internal combustion engine is initiated at a point in time 232, for example on the basis of a starting command being generated by an operator of the internal combustion engine 60. In so doing, the starting system 50, for example a starter generator, is actuated from a point in time 232. As described above, the first ignition of the combustion chamber 66 after the stop phase then occurs at the point in time 234 in the present example. A time interval 240, in which speed data for the internal combustion chamber 60 are detected, begins at the same time as said first ignition of the combustion chamber 66. The time interval 240 has a length, which, for example, is determined on the basis of a predetermined width in degrees of crankshaft rotation, a predetermined number of detected speed data or a detection of a regional maximum rotational speed after the ignition of the combustion chamber 66.

According to one embodiment of the invention, the speed data are detected at predetermined time intervals within the time interval 240. A continuous detection is, however, also possible. As shown in FIG. 2, the detection of the speed data takes place in the present example at the points in time 234, 242, 244, 246, 248 and 250, which are, for example, spaced in each case 10 ms apart from each other.

The detected speed data are stored by the control and regulation device 46 on a storage medium 47, which can be used with the control and regulation device 46. The control and regulation device 46 determines on the basis of the stored speed data whether said data meet a predetermined starter release criterion.

According to one embodiment of the invention, the predetermined starter release criterion is met if the detected speed data represent an increase in rotational speed with a gradient, which exceeds a predetermined threshold value, and/or a regional maximum rotational speed is detected. The gradient of the increase in rotational speed is determined by the control and regulation device 46, for example using a regression algorithm. The regional maximum rotational speed is ascertained by determining a regional maximum compression in a second combustion chamber, which is next to be ignited after the combustion chamber to be ignited first.

In the present example, wherein as previously described the combustion chamber 68 is ignited next after the combustion chamber 66, it is assumed that the regional maximum compression in combustion chamber 68 is determined at the point in time 250. The detection of the speed data is accordingly concluded at the point in time 250.

If the predetermined starter release criterion is met, the control and regulation device 46 causes a starter release of the starting system 50. This preferably only then occurs if the time interval 240 has elapsed. Because the regional maximum rotational speed is determined at the point in time 250 in the present example and, for example, under the assumption that the increase in rotational speed determined in the time interval 240 has a gradient, which exceeds a predetermined threshold value, a starter release is caused immediately after the point in time 250.

The invention claimed is:

1. Method for starting an internal combustion engine having multiple combustion chambers, wherein said internal combustion engine has a starting system and is operated using a start-stop function, and wherein said starting system is actuated after a stop phase in operation of said internal combustion engine to restart said internal combustion engine wherein a combustion chamber to be ignited first of the multiple combustion chambers is determined upon a restart of the internal combustion engine; and after a first ignition of the combustion chamber to be ignited first, speed data for the internal combustion engine are detected, and a starter release of the starting system is caused if the detected speed data meet a predetermined starter release criterion, wherein the predetermined starter release criterion is met if a regional maximum rotational speed is detected, and wherein the regional maximum rotational speed is ascertained by determining a regional maximum compression in a second combustion chamber, the second combustion chamber being next to be ignited after the combustion chamber to be ignited first.

2. The method according to claim 1, wherein the predetermined starter release criterion is met if the detected speed data represent an increase in rotational speed with a gradient, which exceeds a predetermined threshold value.

3. The method according to claim 1, wherein the combustion chamber to be ignited first is determined in the stop phase of the internal combustion engine.

4. The method according to claim 3, wherein the ignition angle, charge and injection timing of the combustion chamber to be ignited first are determined such that the absolute angle and the cylinder-specific ignition angle are known before carryout the restart of the internal combustion engine.

5. The method according to claim 1, wherein the speed data are detected in a predetermined time interval after the first ignition of the combustion chamber to be ignited first.

6. The method according to claim 5, wherein the speed data are detected at predetermined time intervals within the predetermined time interval.

7. The method according to claim 5 wherein the predetermined time interval has a length, which is determined on the basis of a predetermined width in degrees of crankshaft rotation, a predetermined number of detected speed data or a detection of a regional maximum rotational speed after the ignition of the combustion chamber to be ignited first.

8. The method according to claim 5, wherein the starter release of the starting system is only then caused if the predetermined time interval has elapsed.

9. Computer program stored on an electronic storage medium for carrying out the method according to claim 1.

10. Internal combustion engine having multiple combustion chambers, said internal combustion engine having a starting means for performing a start-stop function, and said starting system being actuated after a stop phase in operation of said internal combustion engine to restart said internal combustion engine, wherein a combustion chamber to be ignited first of the multiple combustion chambers can be determined upon a restart of the internal combustion engine; and after a first ignition of the combustion chamber to be ignited first, speed data for the internal combustion engine are detected, and a starter release of the starting system is caused if the detected speed data meet a predetermined starter release criterion, wherein the predetermined starter release criterion, is met if a regional maximum rotational speed is detected, and wherein the regional maximum rotational speed is ascertained by determining a regional maximum compression in a second combustion chamber the second combustion chamber being next to be ignited after the combustion chamber to be ignited first.

11. Control and regulation device configured for carrying out the method according to claim 1.

12. Non-transitory electronic storage medium configured for storing the computer program according to claim 9.

* * * * *